US005864977A

United States Patent [19]

Alvern

[11] Patent Number: 5,864,977

[45] Date of Patent: Feb. 2, 1999

[54] DISPLAY APPARATUS ATTACHABLE TO A FLUID PUMP FILLER GUN

[75] Inventor: Stein Alvern, Oslo, Norway

[73] Assignee: Alvern-Norway A/S, Norway

[21] Appl. No.: 646,963

[22] Filed: May 8, 1996

[51] Int. Cl.[6] ..... G09F 3/00

[52] U.S. Cl. ..... 40/658; 141/98; 222/23

[58] Field of Search ..... 40/658; 141/98, 141/392; 222/23; 248/216.1, 217.3

[56] References Cited

U.S. PATENT DOCUMENTS

| | | | |
|---|---|---|---|
| D. 173,006 | 9/1954 | Anderson . | |
| D. 173,007 | 9/1954 | Anderson . | |
| D. 279,483 | 7/1985 | Goldman . | |
| 289,662 | 12/1883 | Lance | 248/218.3 |
| 725,711 | 4/1903 | Howes | 40/658 |
| 3,322,381 | 5/1967 | Bubb | 40/658 |
| 3,325,929 | 6/1967 | Mauchline | 40/658 |
| 4,125,243 | 11/1978 | Liptak | 40/658 |
| 4,292,749 | 10/1981 | Thomas . | |
| 4,408,791 | 10/1983 | Griffin et al. . | |
| 4,465,209 | 8/1984 | Wilder . | |
| 5,184,655 | 2/1993 | Fell . | |

FOREIGN PATENT DOCUMENTS

| | | |
|---|---|---|
| S-122642 | 2/1995 | Australia . |
| S-123343 | 5/1995 | Australia . |
| 0 476 303 A1 | of 0000 | European Pat. Off. . |
| 0407271A1 | 6/1990 | European Pat. Off. . |
| 62-208396 | 9/1987 | Japan . |
| 62-42268 | 10/1992 | Japan . |
| 980890 | 1/1965 | United Kingdom . |
| 0 608 596 A1 | of 0000 | WIPO . |
| WO 93/15493 | of 0000 | WIPO . |

*Primary Examiner*—Cassandra H. Davis
*Attorney, Agent, or Firm*—Finnegan, Henderson, Farabow, Garrett, & Dunner, L.L.P.

[57] ABSTRACT

A display apparatus for use with a fuel pump filler gun having in sequence a barrel, a head, and a handle, includes a clip. The clip has opposed retaining surfaces biased toward one another. The retaining surfaces are configured to grasp a display between the opposed retaining surfaces and hold the display spaced apart from the filler gun. The display apparatus further includes various techniques for attaching the clip to the filler gun or to a protective boot covering a portion of the filler gun. The display apparatus can provide an expanded display area beyond the limited area of the filler gun itself without interfering with the use of the filler gun during the fueling operation.

9 Claims, 4 Drawing Sheets

DISPLAY APPARATUS ATTACHABLE TO A FLUID PUMP FILLER GUN

BACKGROUND OF THE INVENTION

1. Field of the Invention

The present invention relates to advertising message display devices, and more particularly to a display holder having opposed retaining surfaces and being attachable to a fuel pump filler gun. The display holder permits advertising and other informational messages to be displayed to a customer while fueling his own vehicle, and to be observed upon approaching the gas pumps.

2. Description of the Related Art

Most related art devices are confined to the limited surface area available on the filler gun itself, and are typically confined to the area of the head of the filler gun. Further, many of the related art display devices are not suitable for use with all configurations of filler guns, or else are suitable for use only with a filler gun having a protective boot covering a portion of the filler gun.

A need exists for a display apparatus which may be readily attached to all configurations of filler guns, whether or not the filler gun has a protective boot. The display apparatus should be readily attachable to the head of a filler gun, or to a protective boot covering the head of a filler gun, to provide additional message space in an economical manner without requiring a change of the filler gun or protective boot covering.

SUMMARY OF THE INVENTION

Accordingly, the present invention is directed to a display apparatus that overcomes the limitations and disadvantages of the related art.

An advantage of the present invention is its simple design that is nevertheless capable of providing a display holder that may be readily attached to all existing configurations of filler guns, in order to prominently display advertising and other information to the customer arriving at the fuel pumps or while fueling the vehicle himself.

Another advantage is that the display apparatus can display larger messages than those previously available in the related art, without interfering with the use of the filler gun during the fueling operation.

Additional features and advantages of the invention will be set forth in the description which follows, and in part will be apparent from the description, or may be learned by practice of the invention. The objects and other advantages of the invention will be realized and attained by the display apparatus particularly pointed out in the written description and claims hereof as well as the appended drawings.

To achieve these and other advantages in accordance with the purpose of the invention, as embodied and broadly described, the invention comprises a display holder having opposed retaining surfaces configured to grasp an edge of a display. The edge of the display is held between the opposed retaining surfaces and is spaced apart from a fuel pump filler gun. The display holder can provide significantly larger advertising and informational space than related art displays which are confined to the surface of the filler gun alone. The invention also includes attachment means for attaching the display holder to the head of the filler gun.

In one embodiment, the display apparatus is configured for use with a filler gun having a protective boot covering at least a portion of the head. In this embodiment, the attachment means preferably attaches the display holder to the protective boot. However, the invention is not limited to use only with filler guns protected by a protective boot. The display apparatus of the present invention permits the display holder to be attached either to the head of a filler gun, or to a protective boot covering the head of the filler gun.

Preferably, the display holder is a clip, and is more preferably a spring-loaded clip having opposed retaining surfaces biased toward one another. Depending upon the design requirement for retaining a particular display, the opposed retaining surfaces may define a set of jaws, having either a smooth or rough surface contacting the display. In another embodiment, the display holder is a pair of elongated opposing surfaces hingedly joined pivotably together at one end.

In another embodiment, the display holder includes at least one of the opposed retaining surfaces having one-way rollers to permit insertion and inhibit removal of the display from between the opposed retaining surfaces. Alternatively, both of the opposed retaining surfaces may include one-way rollers to readily permit insertion of a display between the retaining surfaces and inhibit the display from being pulled out of the display holder. To further assist in retaining the display within the display holder, at least one of the opposed retaining surfaces may have a projection which passes through the display and engages the other of the opposed retaining surfaces. The projection is preferably retractable to disengage the opposed retaining surfaces from one another.

In yet another embodiment, at least one of the opposed retaining surfaces includes a display support, e.g., a plastic shield, which projects away from the filler gun, to support the display. Alternatively, each of the opposed retaining surfaces may include a display support. Preferably, at least one display support is transparent to permit viewing of the display therethrough. An alternative to the display support includes a display holder having a frame projecting away from the filler gun to provide support along the perimeter of the display.

Another embodiment includes resiliently biasing the opposed retaining surfaces toward one another. The opposed retaining surfaces may be spaced apart from one another to provide a gap therebetween to receive a display or may be contacting one another and forced apart to receive the display. In yet another alternative, the opposed retaining surfaces may be biased toward one another by an elastic member which is preferably a spring.

The display holder may be formed from various materials, and the attachment means can be any substance or device for securing the display holder to the filler gun. The preferred display holder may be formed from a variety of materials, including plastic, rubber, or metal. The attachment means may include straps, adhesives, anchors and screws, pins, or hooks. When used with a protective boot, the preferred attachment means includes curved pins having a hooked head for penetrating the protective boot. When the display holder is attached directly to the filler gun head, the preferred attachment means is a strap. The attachment means further may involve integrally forming the display holder into the protective boot.

The display has at least one edge, and either one or a plurality of display holders may grasp the display along the edge. Alternatively, at least one display holder may grasp the display along each of opposite edges. The head, or the protective boot covering the head, has an upper surface and opposite side surfaces. In one embodiment, at least one display holder attaches to each of the opposite surfaces of the head to grasp the display, thereby forming an arch bridging the upper surface of the head. Alternatively, at least one display holder may attach to each of the opposite surfaces and the upper surface of the head to grasp at least one display.

It is to be understood that both the foregoing general description and the following detailed descriptions are exemplary only, and are not restrictive of the invention.

BRIEF DESCRIPTION OF THE DRAWINGS

The accompanying drawings are included to provide a further understanding of the invention and are incorporated in and constitute a part of the specification. The drawings illustrate several embodiments of the invention and together with the description, serve to explain the principals of the invention. In the drawings.

A DESCRIPTION OF THE PREFERRED EMBODIMENTS

Reference will now be made in detail to the present preferred embodiments of the invention, examples of which are illustrated in the accompanying drawings.

Figure 1:
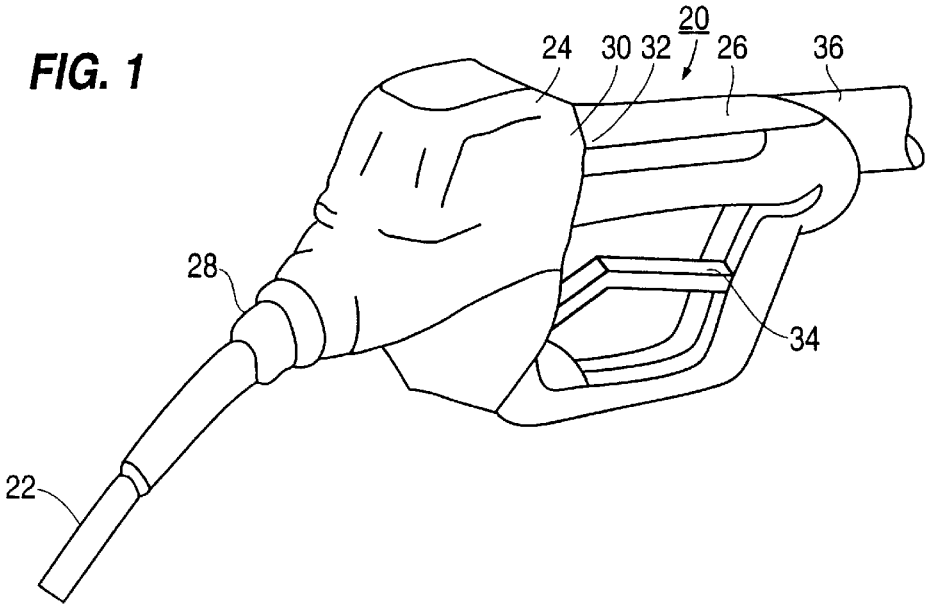
FIG. 1 is a perspective view of a conventional filler gun.

By way of background, a conventional fuel pump filler gun for discharging fuel is illustrated in FIG. 1, designated generally by the reference numeral 20. As shown in FIG. 1, the fuel pump filler gun 20 includes a barrel 22, a gun head 24, and a handle 26. The head 24 has a front end 28 where it joins at a junction with the barrel 22, and a rear end 30. The handle 26 has a front end 32 which joins at a junction with the rear end 30 of the head 24. The handle 26 has a lever 34 which is operatively connected to an internally located valve to control the flow of fuel from a fuel hose 36. The head 24 may be unprotected, or it may be covered by a protective boot 24' of rubber or plastic material.

A display apparatus attachable to a fuel pump filler gun according to the present invention comprises a display holder having opposed retaining surfaces configured to grasp an edge of a display between the opposed retaining surfaces.

Figure 2:
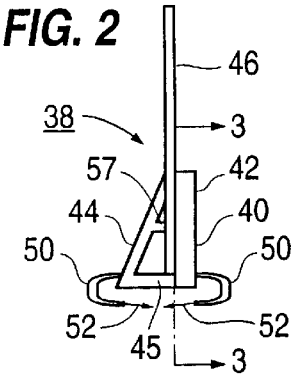
FIG. 2 is a side view of a display apparatus according to one embodiment of the invention.

An exemplary embodiment of the display apparatus of the present invention is shown in FIG. 2 and designated generally by reference numeral 38.

As broadly embodied herein, and referring to FIG. 2, a display holder 40 has opposed retaining surfaces 42 and 44, connected by a bottom portion 45, configured to grasp a display 46. Display 46 may be a cardboard or plastic card, having a variety of possible shapes, on which an advertisement or other text may be displayed. One edge of the display 46 is held between the opposed retaining surfaces 42, 44. Hence, when the display holder 40 is attached to the filler gun 20, the display 46 is spaced a slight distance away from the filler gun 20, at least by the thickness of bottom portion 45. The display holder can be formed of any generally rigid material, including plastic, rubber, or metal.

The display apparatus 38 of the present invention also includes attachment means for attaching the display holder 40 to the head 24, or alternatively to a protective boot 24' covering at least a portion of the head 24 of the filler gun 20. One preferred application of the display apparatus 38 is used with a filler gun 20 having a protective boot 24', because of the additional options available for attaching the display holder 40. Nonetheless, the display apparatus 38 of the present invention permits the display holder 40 to be attached both to the head 24 of a filler gun 20 or to a flexible boot 24' covering the head 24 of the filler gun 20.

Figure 15:
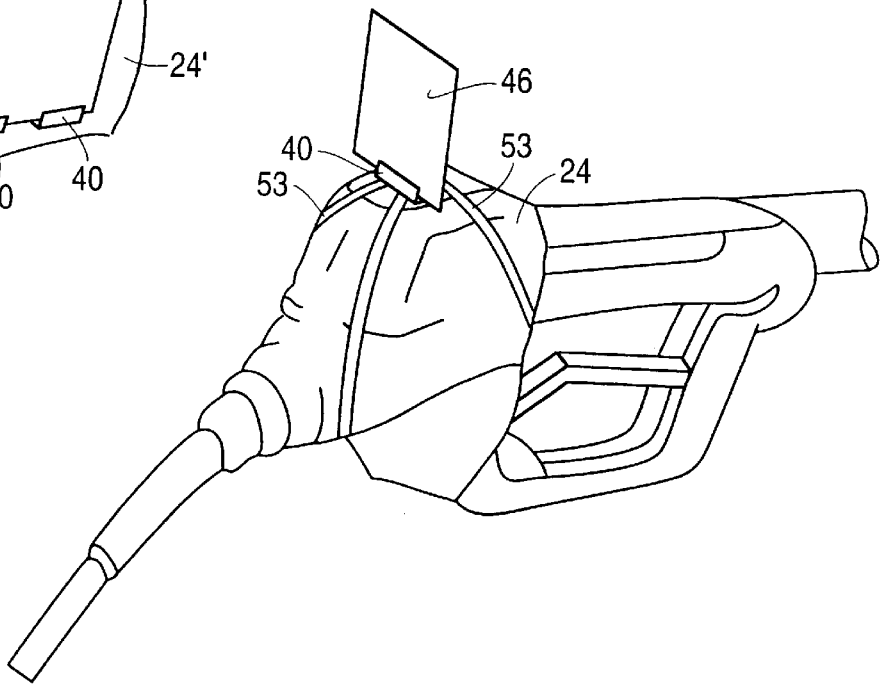
FIG. 15 is a perspective view of a display apparatus attached to a filler gun or a protective boot according to yet another embodiment of the invention.

As broadly embodied herein, and as shown in FIG. 2, a preferred attachment means for use with a protective boot 24' includes curved pins 50, each pin having a hooked head 52 for penetrating the protective boot 24'. The curved pins 50 preferably engage the display holder 40 from opposite directions so as to lock the display holder 40 into position against the protective boot 24'. Other preferred attachment means includes straps, adhesives, anchors and screws, pins, and various shaped hooks. As shown in FIG. 15, for purposes of attaching the display holder 40 directly to the head 24 of a filler gun 20 that is not protected by a protective boot 24', straps 53, which engage a slot in the bottom portion 45 of the display holder 40 and fasten around the head 24 and/or handle 26 of the filler gun 20, is the preferred attachment means. Additionally, the attachment means can include integrally forming the display holder 40 into the protective boot 24'.

Figure 16:
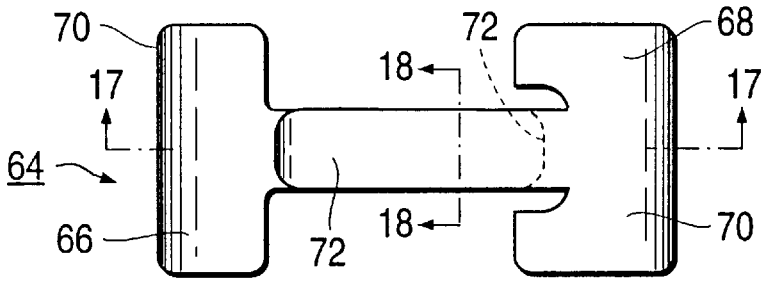
FIG. 16 is a top view of one alternative embodiment of an attachment device for attaching a display apparatus to a protective boot of a filler gun.
Figure 17:
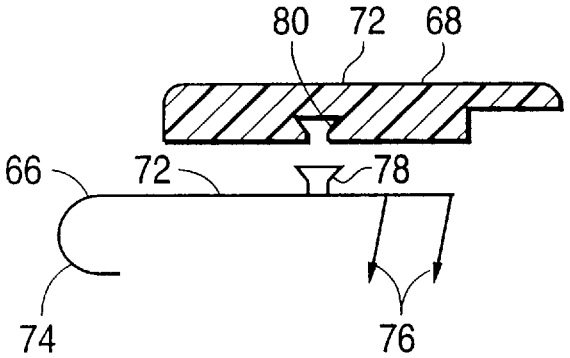
FIG. 17 is a cross-sectional view taken along line 17—17 of FIG. 16.
Figure 18:
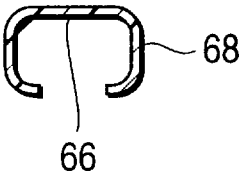
FIG. 18 is a cross-sectional view taken along line 18—18 of FIG. 16.

Another embodiment of a suitable attachment means is broadly depicted in FIGS. 16–18. Referring to FIG. 16, attachment device 64 includes first portion 66 and a second portion 68. Each of the first and second portions 66, 68 include a flat end portion 70 and a flat neck portion 72. The end portion 70 of first portion 66 has a distal curved hook 74 and a set of pins 76 for gripping the protective boot 24'. The first portion 66 also has a tab 78 projecting from an upper surface of neck portion 72. Second portion 68 includes an indentation 80 in a lower surface of neck portion 72 for receiving tab 78 of first portion 66, thereby interlocking the two portions 66, 68 together, attached to protective boot 24'. Display holder 40 next can be fixed to the interlocked neck portion 72 of first and second portions 66, 68.

Figure 3:
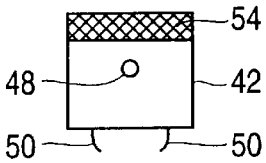
FIG. 3 is a cross-sectional view of FIG. 2 along line 3—3.

As broadly embodied in FIG. 3, which is a cross-sectional view of FIG. 2 along line 3—3, the opposed retaining surfaces may define a set of jaws 54, each jaw having a rough or knurled inner surface to aid in holding the display 46. The texture of the inner surface of jaw 54 contacting the display 46 may be varied according to the design requirements for retaining a particular display 46.

Figure 4:
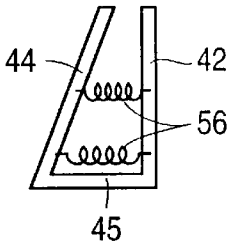
FIG. 4 is a side view of a display apparatus according to another embodiment of the invention.
Figure 5:
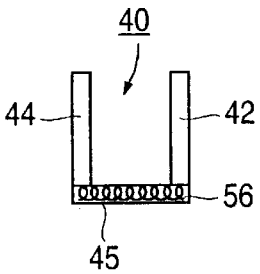
FIG. 5 is a side view of a display apparatus according to yet another embodiment of the invention.
Figure 6:
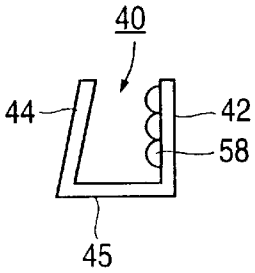
FIG. 6 is a side view of a display apparatus according to yet another embodiment of the invention.

Many variations for a display holder 40 having opposed retaining surfaces 42, 44 are contemplated and the preferred embodiments of these variations will be discussed below. In the embodiment shown in FIG. 4, the display holder 40 is a clip having one or more springs 56 biasing the opposed retaining surfaces 42, 44 toward one another. The spring 56 may be positioned above bottom portion 45, or bottom portion 45 may be hollow with spring 56 mounted therein, as shown in FIG. 5. The clip includes any opposed retaining surfaces 42, 44 resiliently biased towards one another. As shown in FIG. 6, the opposed retaining surfaces 42, 44 themselves may be resilient so as to spring back towards one another when deflected apart from one another by insertion of a display 46 therebetween. Alternatively, the opposed retaining surfaces 42, 44 may be rigid members pulled towards one another by an elastic member, such as a spring, as shown in FIG. 5. The opposed retaining surfaces 42, 44 may be either spaced apart from one another to provide a gap therebetween to receive a display, or may be contacting one another and forced apart to receive the display 46.

To assist in retaining the display 46 within the display holder 40, and referring to FIG. 2, opposed retaining surface 42 may have a projection 57 passing through the display 46 and engaging the other opposed retaining surface 44. For additional securing strength, and to further inhibit removal of the display 46 from the display holder 40, multiple projections 57 may be used to fasten the opposed retaining surfaces 42, 44 together. Further, the projections 57 may extend from both of the opposed retaining surfaces 42, 44. The projection 57 is preferably retractable to disengage the opposed retaining surfaces 42, 44 from one another. One example of a retractable projection 57 includes a threaded bolt passing through one of the opposed retaining surfaces and engaging a threaded receiving hole in the other of the opposed retaining surfaces. However, any configuration of pin or the like would also be suitable.

Figure 7:
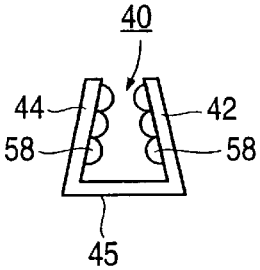
FIG. 7 is a side view of a display apparatus according to yet another embodiment of the invention.

In the embodiment shown in FIG. 6, as an alternative to the display holding projection 57 depicted in FIG. 2, the display holder 40 includes one-way rollers 58 provided in at least one of the opposed retaining surfaces. One-way rollers 58, which are well-known in the art, permit insertion and inhibit removal of the display 46 from between the opposed retaining surfaces 42, 44. The one-way rollers rotate downwards, to allow insertion of display 46 into the clip, but lock up in the reverse direction thereby inhibiting removal of the display. Alternatively, as shown in the embodiment of FIG. 7, both of the opposed retaining surfaces 42, 44 may include one-way rollers 58 to readily permit insertion of the display 46 between the retaining surfaces 42, 44, and inhibit the display 46 from being pulled out of the display holder 40.

Figure 8:
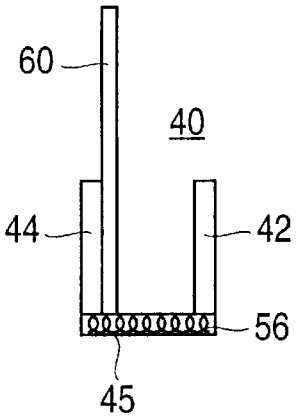
FIG. 8 is a side view of a display apparatus according to yet another embodiment of the invention.
Figure 9:
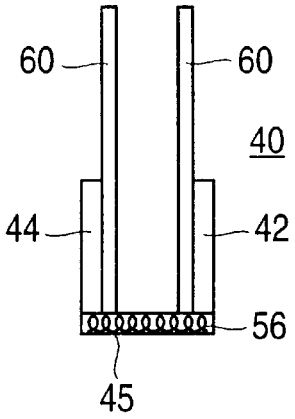
FIG. 9 is a side view of a display apparatus according to yet another embodiment of the invention.

In the embodiment shown in FIG. 8, at least one of the opposed retaining surfaces includes a display support 60 formed to support the display 46. The display support 60, which preferably is made of plastic, projects away from the filler gun 20. An alternative embodiment shown in FIG. 9, provides a display support 60 attached to each of the opposed retaining surfaces 42, 44 to support and protect the display 46. Preferably, at least one display support 60 is transparent to permit viewing of the display by a filler gun user.

Figure 10:
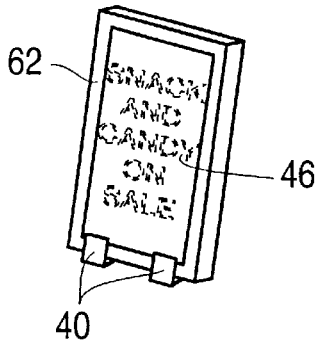
FIG. 10 is a perspective view of a display apparatus according to yet another embodiment of the invention.

Yet another embodiment for a display support is shown in FIG. 10. In this embodiment, the display holder 40 may be provided with a peripheral frame 62 to provide support along the perimeter of the display 46.

Figure 11:
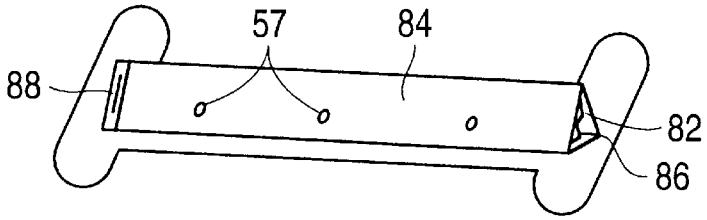
FIG. 11 is a perspective view of a display apparatus according to yet another embodiment of the invention.
Figure 11A:
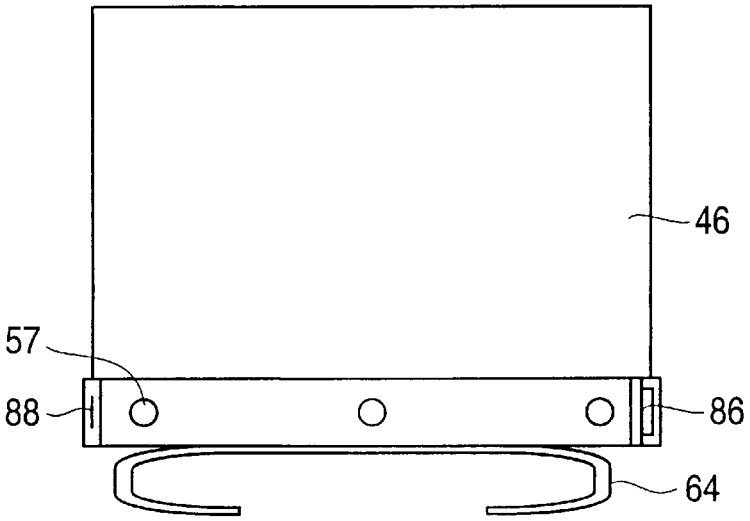
FIG. 11A is a front view of the display apparatus of FIG. 11 holding a display card.
Figure 12:
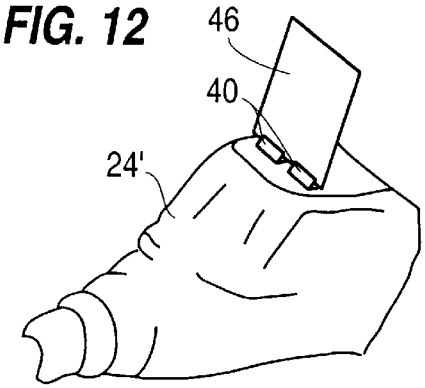
FIG. 12 is a perspective view of a display apparatus attached to a filler gun or a protective boot according to another embodiment of the invention.

Yet another embodiment of a display device 40 is broadly depicted in FIGS. 11 and 12. Referring to FIG. 11, display device 40 includes an elongated base portion 82, shown attached in this embodiment to the attachment means depicted in FIGS. 16–18. An elongated door 84 is pivotably connected to base portion 82 via hinge 86, so that door 84 can swing open and shut. A locking device 88 is provided at the end of base portion 82 and door 84 opposite the hinge 86. Furthermore, the door 84 includes a plurality of spaced projections 57, embedded to engage apertures proximate the edge of the display card 46 and hold the display card in place.

The display apparatus 38 permits many shapes and sizes of displays 46 to be secured to a filler gun 20. The angle from which the display projects may vary, to achieve whatever angle provides the best view of the display. Moreover, the many variations on the orientation of the display holder or display holders 40 provide numerous opportunities to present display configurations not previously available in the related art.

As shown in the embodiment of FIG. 12, the display 46 has at least one edge. Either one display holder 40, or else a plurality of display holders 40, grasp the display 46 along the edge.

Figure 13:
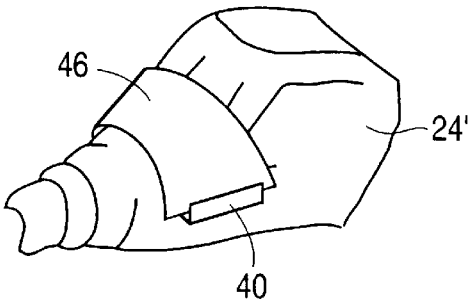
FIG. 13 is a perspective view of a display apparatus attached to a filler gun or a protective boot according to yet another embodiment of the invention.

Moreover, the head 24, or protective boot 24' covering the head 24 has an upper surface and opposite side surfaces. As shown in an alternative embodiment illustrated in FIG. 13, at least one display holder 40 can be attached to each of the opposite side surfaces of the filler gun head 24 or the protective boot 24', for grasping the display 46 along each of two opposite edges, thereby forming an arch bridging over the upper surface of the protective boot 24'.

Figure 14:
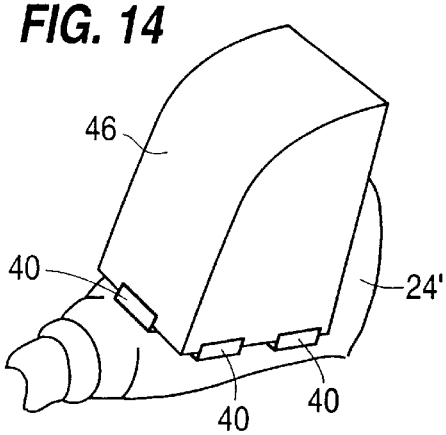
FIG. 14 is a perspective view of a display apparatus attached to a filler gun or a protective boot according to yet another embodiment of the invention.

In another alternative embodiment shown in FIG. 14, at least one display holder 40 is attached to each of the opposite surfaces and the upper surface of the filler gun head 24 or the protective boot 24' for grasping at least one display 46.

The display apparatus of the present invention has many advantages over the related art. Significantly more space for advertising and other information is available due to the countless display configurations that can be attached to the filler gun with the display holder. The easily attachable design provides a display holder, which depending upon the needs of the customer and features incorporated into the display holder itself, for securely holding and even protecting a display. The display apparatus of the present invention can fit on all configurations of gun heads and provides advertising opportunities not previously available.

Specifically, the display holder or holders may be arranged on the head or protective boot of a filler gun to provide advertising space that exposes the target customer to different messages at different stages of the fueling process. Space may be provided so that a message may be easily seen from the side of the filler gun while a customer drives toward the pump. A message may be oriented on the front end upper portion of the head or protective boot to expose the customer to another message while the filler gun is hanging from the pump. Yet another message may be provided on the rear end upper portion of the head or protective boot to expose the customer to additional information while he focuses on the back side of the filler gun during the fueling operation.

While there has been illustrated and described what is at present considered to be a preferred embodiment of the present invention, it will be understood by those skilled in the art that various changes and modifications may be made, and equivalents may be substituted for elements thereof, without departing from the true scope of the invention. Therefore, it is intended that this invention not be limited to the particular embodiments disclosed herein, but that the invention include all embodiments falling within the scope of the appended claims.

What is claimed is:

1. A display apparatus attachable to a surface of a fluid pump filler gun for holding a display, the display including an elongated card having first and second ends, the display apparatus comprising:

a display holder having opposed retaining surfaces configured to grasp the first end of the display between said opposed retaining surfaces and hold the display so that the second end projects away from the filler gun, wherein at least one of said opposed retaining surfaces has a projection for passing through the display and engaging the other of said opposing retaining surfaces, wherein said projection is retractable to disengage one of said opposed retaining surfaces from the other of said opposed retaining surfaces; and attachment means for attaching said display holder to the filler gun.

2. The apparatus of claim 1, wherein said retaining surfaces are spring loaded to bias them toward one another.

3. The apparatus of claim 1, wherein at least one of said opposed retaining surfaces includes a roughened inner surface.

4. The apparatus of claim 1, wherein said opposed retaining surfaces are resiliently biased toward one another.

5. The apparatus of claim 4, wherein said opposed retaining surfaces are contacting one another.

6. The apparatus of claim 1, wherein said attachment means include one of straps, adhesives, anchors and screws, pins, and hooks.

7. The apparatus of claim 1, wherein said arcuate hooks include curved pins having a hooked head for penetrating the protective boot.

8. The apparatus of claim 1, further comprising a second display holder grasping the display along the first edge.

9. The apparatus of claim 8, wherein the filler gun has an upper surface and opposite side surfaces, at least one display holder being attached to each of the opposite surfaces and the upper surface of the filler gun for grasping at least one display.

* * * * *

UNITED STATES PATENT AND TRADEMARK OFFICE

CERTIFICATE OF CORRECTION

PATENT NO.: 5,864,977

DATED: February 2, 1999

INVENTOR(S): Stein Alvern

It is certified that an error appears in the above-identified patent and that said Letters Patent is hereby corrected as shown below:

On title page, in the Abstract, line 1, change "fuel" to --fluid--.

Signed and Sealed this

Eighth Day of June, 1999

*Attest:*

Q. TODD DICKINSON

*Attesting Officer*

*Acting Commissioner of Patents and Trademarks*